US005249329A

United States Patent [19]

Arnold

[11] Patent Number: 5,249,329

[45] Date of Patent: Oct. 5, 1993

[54] SELF-CENTERING BUFFER PAD ASSEMBLY

[75] Inventor: Tracy Arnold, Hillsboro, Mo.

[73] Assignee: S. M. Arnold, Inc., St. Louis, Mo.

[21] Appl. No.: 848,314

[22] Filed: Mar. 9, 1992

[51] Int. Cl.[5] ..... B24D 13/14

[52] U.S. Cl. ..... 15/230; 15/230.17; 15/230.18

[58] Field of Search ..... 15/230, 230.12, 230.14, 15/230.15, 230.17, 230.18, 97.1

[56] References Cited

U.S. PATENT DOCUMENTS 3,990,124 11/1976 MacKay, Jr. et al. ..... 15/230.12
4,607,412 8/1986 Ashworth ..... 15/230
4,692,958 9/1987 McMakin ..... 15/230
5,001,804 3/1991 Roeker et al. ..... 15/230
5,123,139 6/1992 Leppert et al. ..... 15/230

*Primary Examiner*—Edward L. Roberts
*Attorney, Agent, or Firm*—Jerome A. Gross

[57] ABSTRACT

A self-centering buffer pad assembly is constructed of conventional washable buffer pads releasably attached by hook-and-loop material to a support disk permanently covered with hook material; the replaceable buffer pads are lined with the less expensive loop material. The support disk has at its center a projecting tapered hub which acts to center the pad on the disk, and a threaded bushing for attachment of the assembly to a power tool.

2 Claims, 2 Drawing Sheets

SELF-CENTERING BUFFER PAD ASSEMBLY

FIELD OF THE INVENTION

This invention relates to a buffer pad assembly as used for polishing automobiles in which washable replaceable buffer pads are readily attached by self-centering on a support disk.

DESCRIPTION OF THE PRIOR ART

Buffing pad assemblies are known in which a buffing pad is made for engagement with a support disk and affixed to a power tool. The use of hook and loop material to attach the buffing pad to the support disk provides quick and secure assembly as well as washing and re-use of the buffer pad.

A common problem encountered is that hook and loop material with sufficient attaching strength to resist the forces of use in buffing engages so quickly and holds so securely that whenever the pad is initially applied in alignment on the support, disk removal for re-alignment may be difficult and frustrating. Methods previously developed to deal with this problem include use of removable "guide posts" inserted through a central opening of the conventional buffing pad and support disk, as well as special buffer pad assemblies to allow self-centering of the buffer pad on the support disk, a feature whose desirability is stressed in Roeker et al., U.S. Pat. No. 5,001,804.

The present invention solves this problem in using substantially conventional buffer pads of the McKay Jr. et al. U.S. Pat. No. 3,990,124 type, which include: (a) a central threaded aperture for attachment to a power tool, and (b) a buffer pad whose diameter is greater than the diameter of the support disk to provide the pad assembly with a flexible edge.

SUMMARY OF THE INVENTION

A conventional washable buffer pad is releasably attached by hook and loop material to a support disk for use with a power tool. The support disk has at its center a threaded bushing for attachment to the power tool and a projecting tapered hub for centering the pad on the disk. The disk is permanently covered with hook material. The pad is aligned on the disk by bending the pad across center so that its central opening and only a small portion of the loop material surface of the pad are presented to the disk. As the hub engages the central opening of the pad, the hub guides the pad into alignment.

DESCRIPTION OF THE PREFERRED EMBODIMENT

Figure 1:
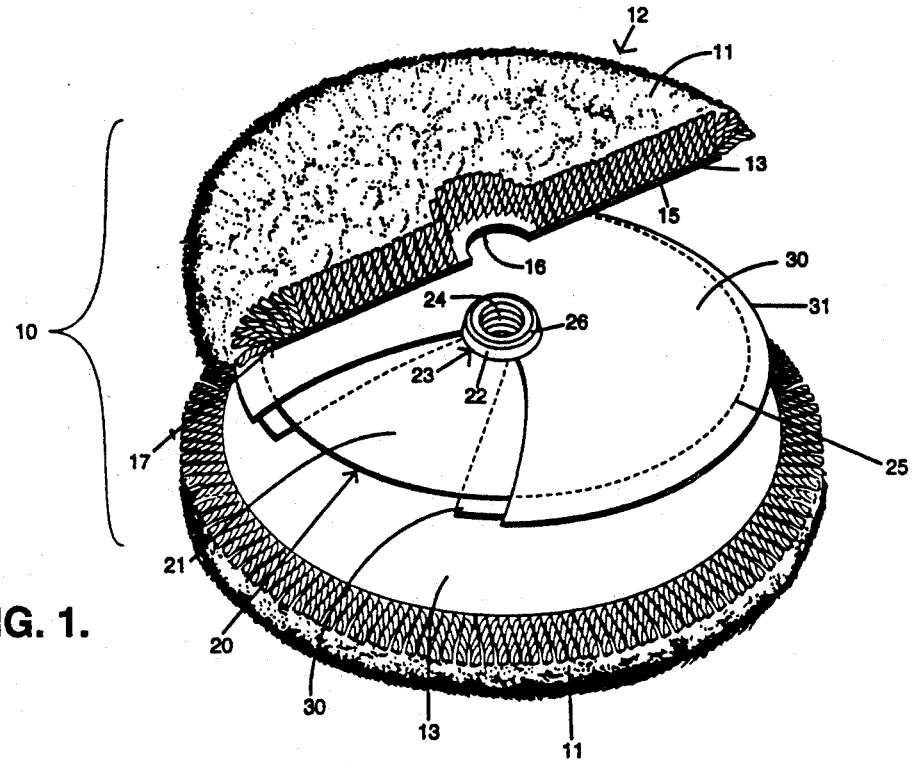
FIG. 1 is an exploded isometric view of a buffer pad assembly embodying the present invention, partially broken away to show hook material covering both sides of the tapered surface portions of the support disk, while loop material covers the adjacent surfaces of the buffer pads.

The buffer pad assembly 10 shown before assembly in FIG. 1 utilizes a rigid molded nylon support disk generally designated 20, whose thickness tapers outward from an integral hub generally designated 23. The hub 23 projects symmetrically from both sides of disk 20, and is preferably not cylindrical but tapers from a larger diameter at the disk surface 21 to a smaller diameter at the hub ends 26 remote therefrom. On the axis of the hub 23 is a threaded metal bushing 24 for attachment of the buffing assembly 10 to a power tool.

Permanently attached to cover the opposite surface portions 21 of disk 20, by any conventional durable adhesive, is "hook" material 30 preferably of the well known "Velcro" type, which on contact with mating "loop" material 13 holds it with security against in-plane movement. The hook material 30 is of greater diameter than the support disk 20, and its projecting outer edges 31 are adhered together by the adhesive, providing the now encased support disk 20 with a somewhat flexible outer edge 31.

The buffer pad generally designated 12 is preferably constructed substantially conventionally of a fabric backing layer 15 which has been tufted with wool yarn 11. On the side of the backing layer 15 opposite the tufting, loop material 13 is mounted; both it and the backing are impregnated with hot melt glue to form a strong but manually bendable pad base generally designated 17. The diameter of the pad base 17 is greater than the diameter of the outer edge 31 of the hook material 30. The pad 12 has a central bore 16 through its base 17 for assembly with the encased support disk 20.

Figure 2:
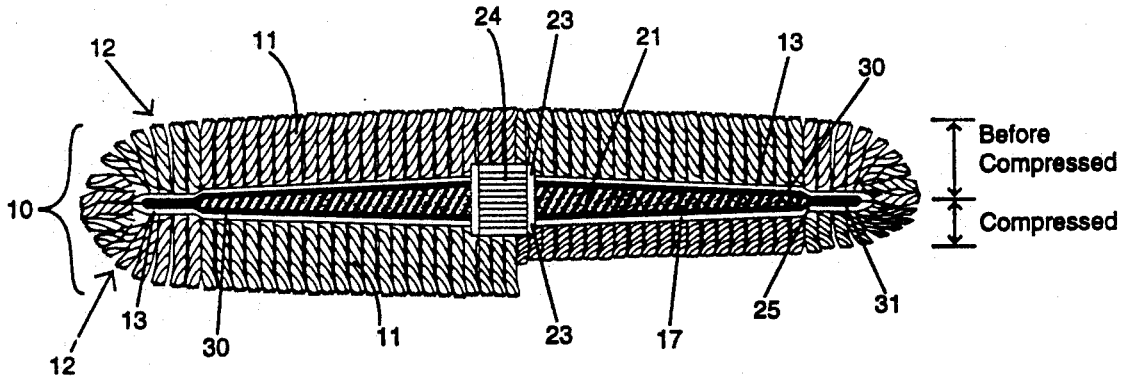
FIG. 2 is a cross sectional view of an assembled buffer pad assembly as shown in FIG. 1, a part of the left side thereof being omitted. The lower right portion of the buffer pad is shown compressed, as in use.
Figure 2A:
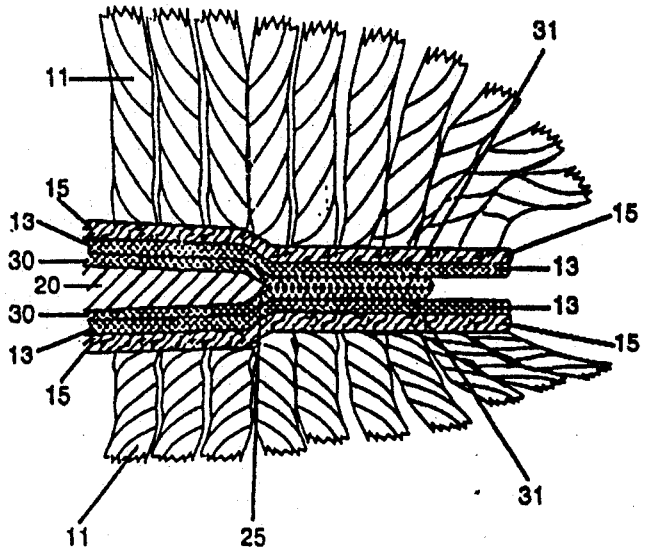
FIG. 2*a* shows the right tip end of the FIG. 2 assembly further enlarged.

As seen in FIG. 2, the progression of diameters of the disk edge 25, to the hook material edge 31 to the buffer pad base 17, provides a somewhat flexible edge to the assembly 10. Further, the hub 23 projects beyond the hook material 30 at least two times the thickness of the pad base 17, but not as far—preferably only about half as much—as the compressed height b of the buffing pad 12 when in normal use, as in polishing automobiles.

Figure 3:
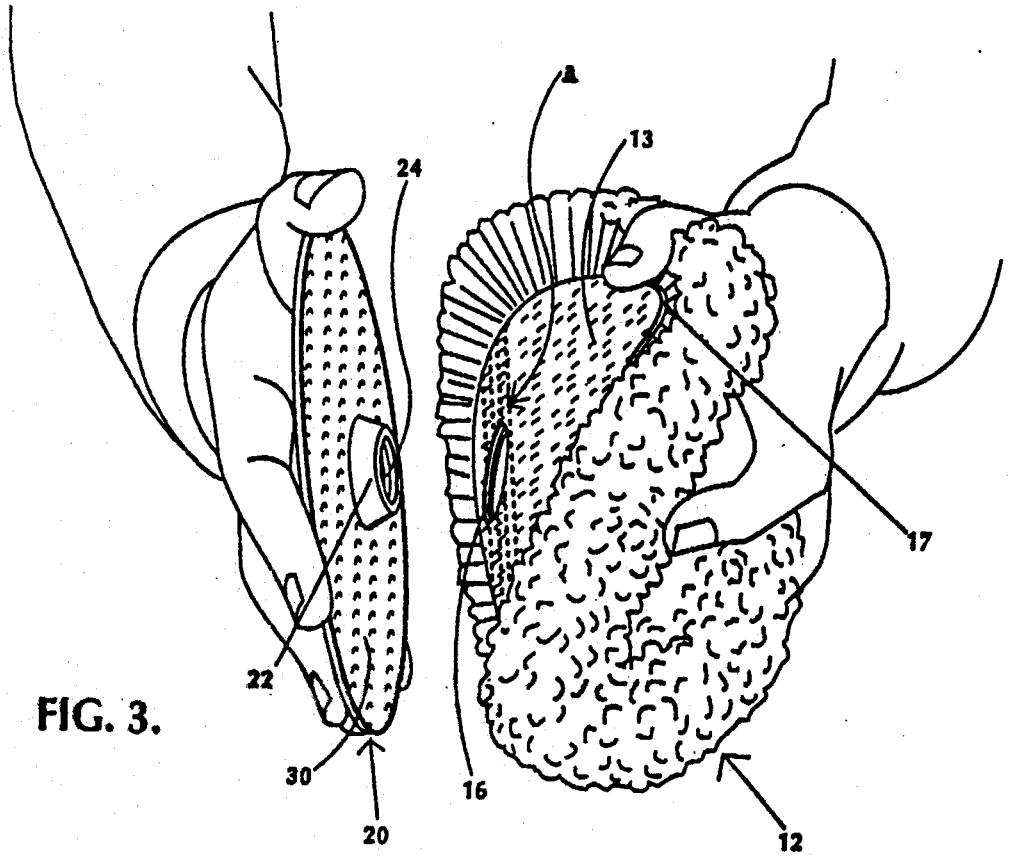
FIG. 3 illustrates how a buffer pad is located for self-centering on the support disk by locating the central aperture of the buffer pad onto the hub portion of the support disk.

The preferred manner of assembly of pad 12 on the encased support disk 20 is illustrated in FIG. 3. Holding the encased disk 20 in one hand and the pad 12 in the other, the pad base 17 is bent back across center so that the bore 16 and only a small area a extending diametrically across the pad 12 of the loop material 13 is initially presented against the hook material 30 on the encased support disk 20. As the hub 23 engages with the pad bore 16, the tapering surface 22 of hub 23 guides the pad 12 into central alignment on the encased support disk 20. The remainder of the loop material 13 is then smoothed into contact with the hook material 30 on the encased support disk 20. The process is repeated with the second pad 12 on the opposite side of the encased support disk 20.

While the presently preferred material for the support disk is nylon, any material with sufficient strength that can be readily formed to the desired shape may be used.

In the preferred embodiment, hook material, being more expensive, is attached to the support disk while loop material is used on the replaceable pads. Nevertheless, the two may be interchanged. Further, other types of material not now known by the inventor whose surface may interlock on contact may be used. Any suitable adhesive may be used to form the pad base.

While 100% wool is preferred for the tufted buffing material, any suitable buffing or polishing material may be used whose compressed height is safely greater than the projection of the hub from the disk.

Since various modifications may be made in the apparatus in use herein described without departing from the scope of the invention, all matter contained in the foregoing description shall be taken as illustrative rather than limiting.

I claim:

1. A buffer assembly comprising a pair of circular buffing pads each having a manually bendable buffer pad base with a center bore, both said pad bases being covered with either a hook type or a loop type of interlocking sheet material, the opposite side bearing tufted buffering material, in combination with a substantially rigid tapered support disk having a central integral hub portion projecting symmetrically from both sides of said disk, said hub portion having at its center a threaded bushing, said disk having an outer diameter less than the diameter of said pad base, the surface portions of both sides of said disk outward of said hub portion being adherently covered with the other of said types of interlocking sheet material, whereby on mounting said pair of buffing pads on opposite sides of said disk, both will interlock with the covering on said disk but their outer edges will not interlock with each other, said hub projecting beyond the thickness of said sheet material on said disk a distance at least twice as great as the thickness of said buffer pad bas and less than the compressible thickness of said buffer pad, whereby on manually bending a buffer pad back along a diameter thereof, said center bore of said buffer pad base may be located against said hub portion and guided by said hub portion into alignment with said disk without contacting so great a portion of their said interlockiing materials as to make centering location difficult.

2. The buffer assembly defined in claim 1, wherein the said coverings of said disk extend to a diameter less than that of said buffing pads but greater than that of said disk, said portions of said disk coverings extending beyond the disk diameter being adhesively secured together, whereby to provide the disk with a somewhat flexible outer edge.

* * * * *